US010731903B2

(12) United States Patent
Weng et al.

(10) Patent No.: US 10,731,903 B2
(45) Date of Patent: Aug. 4, 2020

(54) SYSTEM AND METHOD FOR DEVICE UNDER TEST COOLING USING DIGITAL SCROLL COMPRESSOR

(71) Applicant: Temptronic Corporation, Mansfield, MA (US)

(72) Inventors: Chuan Weng, Mansfield, MA (US); Norbert Elsdoerfer, Mansfield, MA (US)

(73) Assignee: Temptronic Corporation, Mansfield, MA (US)

( * ) Notice: Subject to any disclaimer, the term of this patent is extended or adjusted under 35 U.S.C. 154(b) by 47 days.

(21) Appl. No.: 15/947,415

(22) Filed: Apr. 6, 2018

(65) Prior Publication Data

US 2018/0313589 A1 Nov. 1, 2018

Related U.S. Application Data

(60) Provisional application No. 62/492,466, filed on May 1, 2017.

(51) Int. Cl.
*F25B 49/02* (2006.01)
*F25B 41/04* (2006.01)
(Continued)

(52) U.S. Cl.
CPC ..... *F25B 41/04* (2013.01); *F04C 18/0215* (2013.01); *F04C 23/008* (2013.01);
(Continued)

(58) Field of Classification Search
CPC .... F25B 1/04; F25B 7/00; F25B 40/00; F25B 41/04; F25B 49/022
See application file for complete search history.

(56) References Cited

U.S. PATENT DOCUMENTS 6,601,397 B2 * 8/2003 Pham ..... F04C 27/005 62/181
2006/0225876 A1 * 10/2006 Shimizu ..... F25B 49/02 165/263
2014/0144165 A1 * 5/2014 Flynn ..... F25B 9/00 62/115

FOREIGN PATENT DOCUMENTS

AU 2005201354 A1 4/2005
EP 1953388 A1 8/2008
WO 2013006424 A2 1/2013

OTHER PUBLICATIONS

International Search Report and Written Opinion in corresponding International Application No. PCT/US2018/030091, dated Jul. 17, 2018; 11 pages.

* cited by examiner

*Primary Examiner* — Jonathan Bedford
(74) *Attorney, Agent, or Firm* — Burns & Levinson LLP; Steven M. Mills

(57) ABSTRACT

A device under test cooling system has a refrigerant line and a fluid line extending through a plurality of successively arranged heat exchangers. A digital scroll compressor has an intake for providing the refrigerant mixture to the compressor and a discharge connecting the compressor to the refrigerant line to provide the refrigerant mixture to the heat exchangers. The compressor includes a plurality of scroll elements between the intake and the discharge for compressing the refrigerant mixture. The compressor includes a valve configured to separate the scroll elements when in an open position to allow refrigerant to flow freely between the intake and the discharge. When the valve is in a closed position, the scroll elements compress the refrigerant. A controller is configured to switch the valve between an open and closed position based on a set duty cycle.

16 Claims, 8 Drawing Sheets

(51) Int. Cl.

| | |
|---|---|
| ***F25B 1/04*** | (2006.01) |
| ***F25B 40/00*** | (2006.01) |
| ***F25B 7/00*** | (2006.01) |
| ***F04C 27/00*** | (2006.01) |
| ***F25B 9/00*** | (2006.01) |
| ***F25B 31/02*** | (2006.01) |
| ***F04C 18/02*** | (2006.01) |
| ***F04C 28/26*** | (2006.01) |
| ***F04C 23/00*** | (2006.01) |
| *F25B 25/00* | (2006.01) |

(52) U.S. Cl.

CPC ..... *F04C 27/005* (2013.01); *F04C 28/26* (2013.01); *F25B 1/04* (2013.01); *F25B 7/00* (2013.01); *F25B 9/006* (2013.01); *F25B 31/026* (2013.01); *F25B 40/00* (2013.01); *F25B 49/022* (2013.01); *F25B 25/005* (2013.01); *F25B 2400/01* (2013.01); *F25B 2400/13* (2013.01); *F25B 2400/23* (2013.01); *F25B 2600/02* (2013.01); *F25B 2600/0262* (2013.01); *F25B 2600/23* (2013.01); *F25B 2700/21172* (2013.01); *F25B 2700/21173* (2013.01)

SYSTEM AND METHOD FOR DEVICE UNDER TEST COOLING USING DIGITAL SCROLL COMPRESSOR

CROSS REFERENCE TO RELATED APPLICATIONS

This application claims priority to and the benefit of U.S. Provisional Patent Application No. 62/492,466, filed on May 1, 2017 and titled "Auto-Cascade Refrigeration System for Fluid Cooling Using Digital Scroll Compressor", the contents of which are incorporated herein by reference as though fully set forth herein.

FIELD OF THE INVENTION

The subject disclosure relates to cooling systems, and more particularly, to fluid cooling for Device Under Test (DUT) testing.

BACKGROUND OF THE INVENTION

DUT testing systems often require a very cold cooling fluid during testing. The cooling fluid can be obtained from a refrigeration system. Typical refrigeration systems used for DUT testing are configured to operate only in a single mode which provides maximum cooling to the cooling fluid. If maximally cooled fluid is not needed for the DUT testing system, the fluid is then reheated to a desired temperature. For example, if the refrigerant system cools the fluid to −90 degrees Celsius, and a fluid of −40 degrees Celsius is required for the DUT testing system, the fluid will be heated from −90 degrees Celsius to −40 degrees Celsius after leaving the refrigerant system and before entering the DUT testing system. This method inherently demands energy, and energy is wasted as the fluid is cooled to an unnecessarily low temperature, only to be heated back up before being used.

SUMMARY OF THE INVENTION

In light of the needs described above, in at least one aspect, there is a need for a DUT testing system which is energy efficient, stable, and accurately cools fluid to a desired target temperature.

In at least one aspect, the subject technology relates to a device under test (DUT) cooling system having a refrigerant line and a fluid line extending through a plurality of heat exchangers. The heat exchangers are arranged successively and configured to transfer heat between a refrigerant mixture in the refrigerant line and a fluid in the fluid line. A digital scroll compressor has an intake for providing the refrigerant mixture to the digital scroll compressor. The digital scroll compressor also has a discharge connecting to the refrigerant line to provide the refrigerant mixture to the heat exchangers. Further, the digital scroll compressor has a plurality of scroll elements between the intake and the discharge for compressing the refrigerant mixture. Finally, the digital scroll compressor has a valve configured to separate the scroll elements when in an open position to allow refrigerant to flow freely between the intake and the discharge. When the valve is in a closed position, the scroll elements compress the refrigerant. The system also includes a controller configured to switch the valve between an open and closed position based on a set duty cycle.

In at least one embodiment, the system includes a plurality of sensors configured to measure a plurality of variables.

In such a case, the controller is further configured to determine the set duty cycle based on a target fluid temperature and the variables. Further, the controller is configured to determine a new set duty cycle, after a set time period has passed, based on the target fluid temperature and the variables. The variables can include an output temperature of fluid exiting the system, a fluid input temperature, and a fluid flow rate.

In some embodiments, the digital scroll compressor has a motor oscillating the scroll elements with respect to one another at a uniform rate. In some embodiments, the set duty cycle includes an unload time limit of 90%. The set duty cycle can repeat after at least 10 seconds have passed. In some embodiments, the set duty cycle is modified to cool the fluid to below the target fluid temperature within the heat exchangers. In such a case, the system can also have a heater thermally coupled to the fluid line downstream of the heat exchangers and configured to heat fluid within the fluid line to the target temperature. For example, the set duty cycle can be modified to cool the fluid to between 3 and 7 degrees Celsius below the target fluid temperature.

In some embodiments, the intake of the digital scroll compressor receives the refrigerant mixture from a low pressure side of the refrigerant line. The discharge of the digital scroll compressor can discharge refrigerant to a condenser, which in turn discharges to a high pressure side of the refrigerant line. At the intake of the digital scroll compressor, the refrigerant mixture can include a first refrigerant having a first boiling point, a second refrigerant having a second boiling point, and a third refrigerant having a third boiling point. The first boiling point is greater than the second boiling point and the second boiling point is greater than the third boiling point. The system can also have a plurality of separators, each separator connected to the refrigerant line between two of the plurality of heat exchangers to separate a first mixture from a second mixture. The first mixture is substantially gas and the second mixture is substantially liquid. The first mixture is provided to the high pressure side and the second mixture is provided to an expander before being provided to the low pressure side. In some embodiments, a first separator is connected to the high pressure refrigerant line between a first heat exchanger and a second heat exchanger, the separator configured to separate a liquid mixture comprising the first and second refrigerant from a gaseous mixture comprising the second and third refrigerants. The liquid mixture is provided from the first separator to an expander before being provided to the low pressure side of the refrigerant line within the second heat exchanger. The gaseous mixture is provided to the high pressure side of the refrigerant line within the second heat exchanger.

In at least one aspect, the subject technology relates to a method of operating a device under test (DUT) cooling system. The method includes providing a refrigerant line and a fluid line extending through a plurality of heat exchangers. The heat exchangers are arranged successively and configured to transfer heat between a refrigerant mixture in the refrigerant line and a fluid in the fluid line. A digital scroll compressor is also provided. The digital scroll compressor has an intake for providing the refrigerant mixture to the digital scroll compressor. The digital scroll compressor has a discharge connecting to the refrigerant line to provide the refrigerant mixture to the heat exchangers. The digital scroll compressor also has a plurality of scroll elements for compressing the refrigerant mixture between the intake and the discharge. The digital scroll compressor includes a valve configured to separate the scroll elements when in an open position to allow the refrigerant mixture to flow freely between the intake and discharge, the scroll elements compressing the refrigerant when the valve is in the closed position. The method includes configuring a controller to determine a set duty cycle and switch the valve between the open position and the closed position based on a set duty cycle such that the fluid exits the system substantially at a target fluid temperature.

In some embodiments, the method further includes providing a plurality of sensors configured to measure a plurality of variables. The controller is configured to determine the set duty cycle based on the variables. After a set time period, a new set duty cycle is determined based on the target fluid temperature and the variables. The variables can include an output temperature of fluid exiting the system, a fluid input temperature, and a fluid flow rate.

In some embodiments, the digital scroll compressor comprises a motor oscillating the scroll elements with respect to one another at a uniform rate. In some embodiments, the set duty cycle can include an unload time limit of 90%. In some cases the set duty cycle repeats after at least 10 seconds have passed. The method can further include modifying the set duty cycle to cool the fluid to below the target fluid temperature within the heat exchangers. In such a case, a heater can be provided and thermally coupled to the fluid line downstream of the heat exchangers. The heater is configured to heat fluid within the fluid line to substantially the target fluid temperature. In some embodiments, the method includes modifying the duty cycle to cool the fluid to between 3 and 7 degrees Celsius below the target fluid temperature.

In some embodiments, the discharge of the digital scroll compressor is connected to a condenser which connects to a high pressure side of the refrigerant line. The intake of the digital scroll compressor is then connected to a low pressure side of the refrigerant line. A refrigerant mixture is provided at the intake of the digital scroll compressor. The refrigerant mixture includes a first refrigerant having a first boiling point, a second refrigerant having a second boiling point, and a third refrigerant having a third boiling point. The first boiling point is greater than the second boiling point and the second boiling point is greater than the third boiling point. The method can further include providing a plurality of separators, each separator connected to the refrigerant line between two of the plurality of heat exchangers to separate a first mixture from a second mixture. The first mixture is substantially gas and the second mixture is substantially liquid. The first mixture is provided to the high pressure side and the second mixture is provided to an expander before being provided to the low pressure side.

In some embodiments, a first separator of the plurality of the separators is connected to the high pressure refrigerant line between a first heat exchanger of the plurality of heat exchangers and a second heat exchanger of the plurality of heat exchangers. The first separator is configured to separate a liquid mixture comprising the first and second refrigerant from a gaseous mixture comprising the second and third refrigerants. The liquid mixture from the first separator is provide to an expander, and then provided to the low pressure side of the refrigerant line within the second heat exchanger. The gaseous mixture is provided to the high pressure side of the refrigerant line within the second heat exchanger.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figure 1:
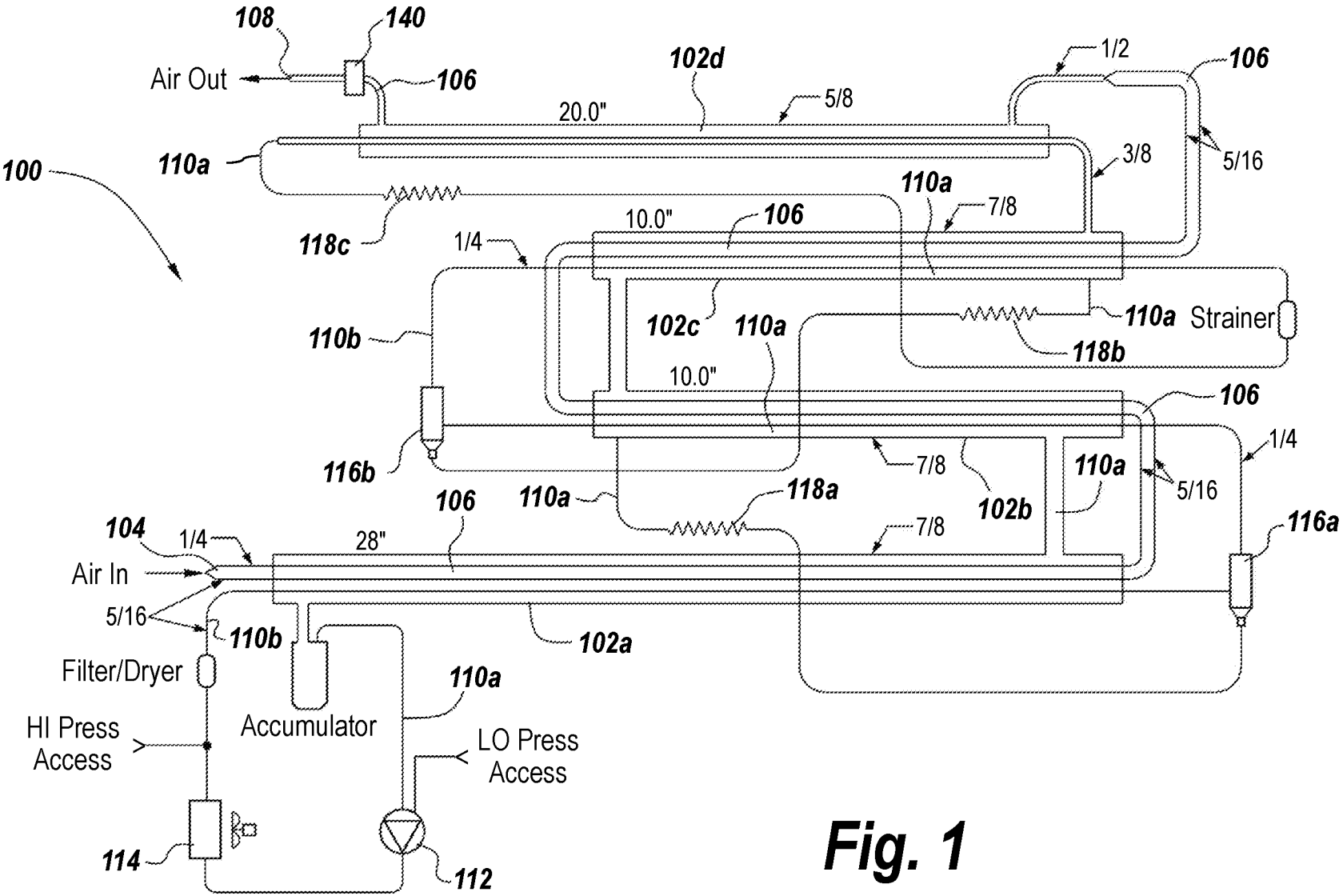
FIG. 1 is a schematic diagram of a refrigeration system in accordance with the subject technology.

The subject technology overcomes many of the prior art problems associated with cooling systems used for DUT testing. In brief summary, the subject technology provides a system and method which uses a refrigeration system with multiple heat exchangers and a built in digital scroll compressor. The advantages, and other features of the systems and methods disclosed herein, will become more readily apparent to those having ordinary skill in the art from the following detailed description of certain preferred embodiments taken in conjunction with the drawings which set forth representative embodiments of the present invention. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

Referring now to FIG. 1, a schematic diagram of a refrigeration system in accordance with the subject technology is shown generally at 100. The working fluid for the system 100 enters the system 100 at through an intake 104 and is provided to a first heat exchanger 102*a* via a fluid line 106. The working fluid can be dry air, or any other type of working cooling fluid for a typical DUT testing system. The fluid line 106 directs the fluid through second, third, and fourth successively arranged heat exchangers 102*b*, 102*c*, 102*d* (functioning like an auto-cascade refrigeration system, as are known in the art) before the fluid exits the system 100 in a cooled state at discharge 108. The cooling of the fluid is accomplished within the heat exchangers 102*a*-102*d* (generally 102) as condensed refrigerants are subsequently expanded to cool the heat exchangers 102.

In the example shown, a refrigerant line (generally 110) running through the heat exchangers has a low pressure side 110*a* and a high pressure side 110*b*. The refrigerant line 110 provides refrigerant mixture from the low pressure side 110*a* to a digital scroll compressor 112, discussed below in more detail. The compressed fluid is then provided to the high pressure side 110*b* of the refrigerant line 110. The refrigerant is passed through a condenser 114 before being provided to the heat exchangers 102. In FIG. 1, four heat exchangers 102 are cooled by a refrigerant mixture of three different refrigerants, however different numbers of heat exchangers and/or refrigerant mixtures can be used in accordance with the teachings described herein.

In one example, the system 100 can use a refrigerant mixture of three refrigerants—R236fa, R23 and R14 with descending boiling points. The three refrigerants in gaseous form are charged into the system in a typical mass ratio of 52% (R236fa), 29% (R23), and 19% (R14). The refrigerant line 110 feeds the refrigerant mixture into the digital scroll compressor 112 which works to compress all three gases together to a high temperature and high pressure superheated gas, as discussed in more detail below. In some cases, the discharge gas temperature and pressure from the digital scroll compressor 112 can be as high as 130 degrees Celsius and 300 psig. After exiting the digital scroll compressor 112, the discharge gas is cooled off in the air-cooled condenser 114 in which the R236fa is condensed and cooled to near room temperature, while remaining at a high pressure. The R23 and R14 gases will remain in a gaseous state at the condenser 114 outlet under the high pressure. When the refrigerant mixture of gas and liquid is sent through the first heat exchanger 102*a*, the R23 is condensed along the way by low temperature refrigerants which entered the first exchanger from the low pressure side 110*a*. After leaving the first heat exchanger 102*a*, the R236fa and R23 liquid mixture is separated from a mixture of R23 and R14 gas in a first gas-liquid separator 116*a*. The high pressure liquid mixture is then expanded, within an expander 118*a*, to a low pressure refrigerant which boils at a low temperature. The expanded refrigerant mixture is sent to the low pressure side 110*a* of the second heat exchanger 102*b* for the condensing of the remaining R23/R14 gas mixture. After exiting the second heat exchanger 102*b*, the R23/R14 mixture is again provided to a separator 116*b*, which separates the R23/R14 mixture into a liquid mixture and a gaseous mixture. The liquid mixture is again expanded in an expander 118*b*, this time being provided to the low pressure side 110*a* of the third heat exchanger 102*c*. The gaseous mixture is passed on through the third heat exchanger 102*c*. Eventually, only R14 may remain as the refrigerant is expanded in a third expander 118*c* before passing through the fourth heat exchanger 102*d* and being provided to the low pressure side 110*a* of the third heat exchanger 102*c*.

As can be seen, the expanded gas produces the next level of cold temperature for the condensing of the separated gas of lower boiling point in the heat exchangers 102. The temperature of each heat exchanger 102 is cascaded down (i.e. reduced) through each heat exchanger 102 as a result of the separation out of the previously expanded refrigerant. In this way, as the fluid line 106 directs the fluid through the successively arranged heat exchangers 102, the fluid is progressively cooled at each heat exchanger 102. Therefore the working fluid has reached its coolest when it is discharged out of the system 100 at discharge 108.

Notably, the compressor 112 can be operated at various duty cycles to increase or decrease fluid cooling, as described in more detail below. As the compressor's 112 duty cycle changes, the suction pressure also changes. This means the low pressure side 110*a* pressure in the each heat exchangers 102 also changes. As the duty cycle is reduced, the suction pressure increases. So does the boiling temperature of the mixture in each heat exchanger 102. This means the boiling temperature also increases. For example, if the air output temperature required is −45 degrees Celsius, the final heat exchanger 102*d* temperature only needs to be about −55 degrees Celsius. The low pressure side 110*a* pressure can be as high as 50 psi. The duty cycle of the compressor 112 is reduced to meet this need. Therefore, energy saving is accomplished.

In another example, when the cooling system 100 operates at full capacity, 12 CFM flow of input air temperature starts at 25 degrees Celsius and leaves the system 100 at an exit fluid temperature of −100 degrees Celsius with a final evaporator pressure of 45 psig and the coolant evaporating temperature of −104 degrees Celsius. If −45 degrees Celsius is needed instead of −100 degrees Celsius for the flow, the capacity of the compressor 112 can be reduced so that the final heat exchanger 102*d* pressure rises accordingly. In any case, the compressor 112 works with the heat exchangers 102 within the system 100 to obtain the desired fluid temperature of fluid leaving the system 100, the fluid then being available to cool a DUT testing system.

Further, in some cases, the fluid can be cooled to slightly below a target temperature within the heat exchangers 102, it being easy to reheat the fluid slightly before it leaves the system 100. For example, the system 100 can include a heater 140. Assuming a target fluid temperature of −45 degrees Celsius, heating up 12 CFM air flow from −50 degrees Celsius to −45 degrees Celsius requires only about 34 Watts heating power. Heating the same amount of air from −90 to −45 degrees Celsius requires about 307 Watts heating power. Therefore the duty cycle of the system 100 is set so that the fluid is cooled to −50 degrees Celsius within the heat exchangers 102, which is below the target temperature of −45 degrees Celsius. Then a controller 502 (discussed in more detail below) trims the air temperature to meet the demand of the target temperature with only a small amount of energy use. During a higher air flow, a higher duty cycle is used, using more energy to cool and re-heat air.

Figure 2:
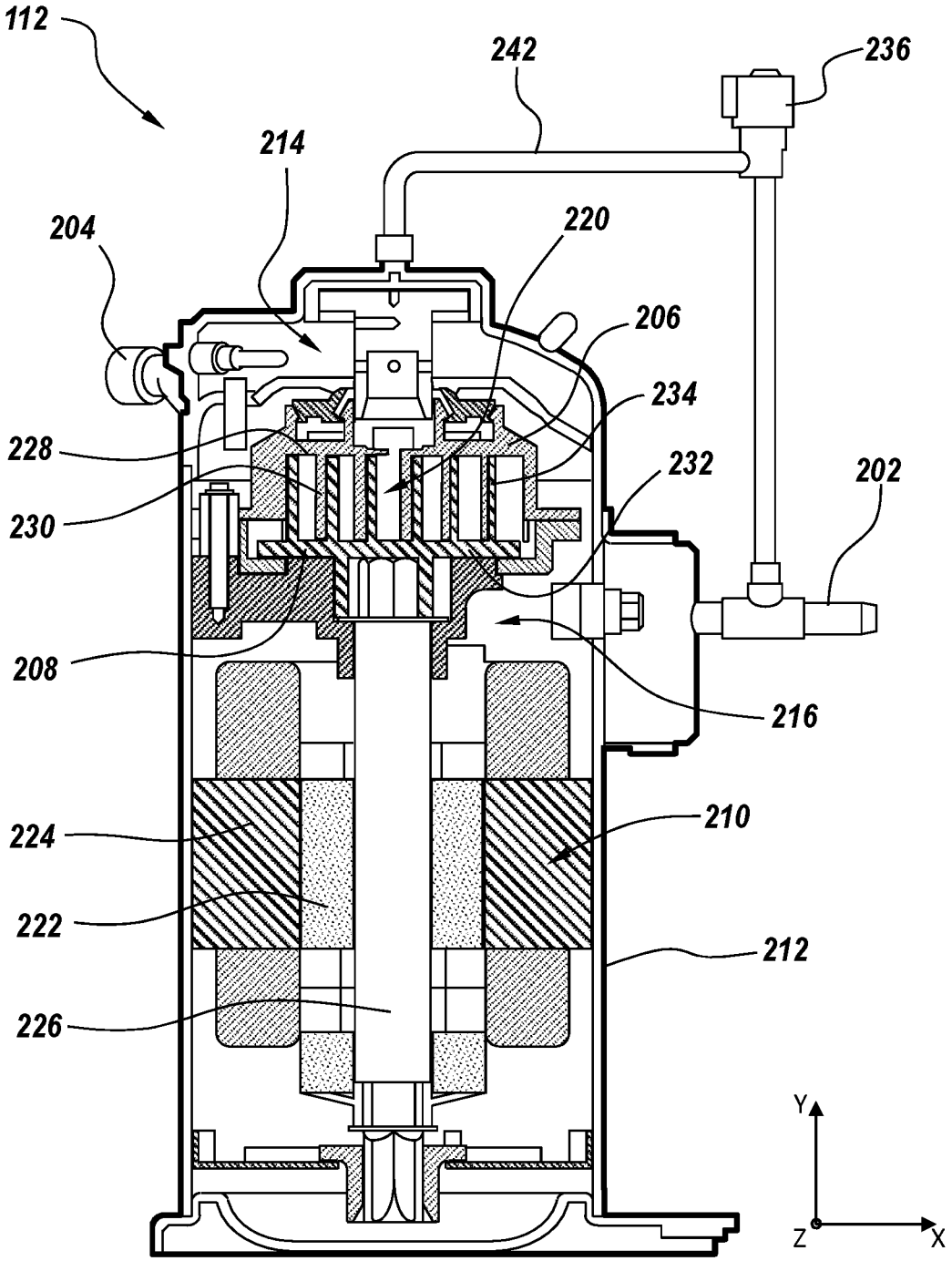
FIG. 2 is a cross sectional view of a digital scroll compressor in accordance with the subject technology.

Referring now to FIG. 2, a cross sectional view of the digital scroll compressor 112 is shown. The digital scroll compressor 112 functions to compress the refrigerant mixture which is then provided to the heat exchangers 102. The digital scroll compressor 112 can be a typical digital scroll compressor such as the type sold by Copeland Corporation, LLC, of Sidney, Ohio, USA, and/or its subsidiaries, successors or assigns, or other such digital scroll compressor. The digital scroll compressor 112 includes an intake 202, a discharge 204, and scroll elements 206, 208 actuated by a motor 210. A thermal overload (not distinctly shown) is built into the digital scroll compressor 112, designed to trip and open the power supply to the motor 210 if the compressor 112 becomes too hot. A shell houses 212 the components of the digital scroll compressor 112 and helps form upper and lower chambers 214, 216 which enclose the refrigerant mixture in a gaseous state. The refrigerant mixture enters through the intake 202 and into the lower chamber 216. The refrigerant mixture than passes through a central section 220 proximate to the scroll elements 206, 208 before passing through the upper chamber 214 and into the discharge 204 where the refrigerant mixture is then returned to the refrigerant line 110. The motor 210 includes a rotor 222 and stator 224 assembly which actuates a central shaft 226 to drive the lower scroll element 208, causing the lower scroll element 208 to oscillate along a lateral plane (x-z axes) with respect to the upper scroll element 206 which is fixed with respect to the lateral plane. The upper scroll element 206 includes a body portion 228 extending along the lateral plane off of which a plurality of upper fingers 230 extend longitudinally (i.e. along the y axis) downward. Similarly, the lower scroll element includes a body portion 232 extending along the lateral plane off of which a plurality of lower fingers 234 extend longitudinally (i.e. along the y axis) upward.

As will be discussed in more detail below, the digital scroll compressor 112 includes a solenoid valve 236 which controls the respective position of the scroll elements 206, 208 along the y axis (e.g. the upper scroll element 206 is stationary and the valve 236 moves the lower scroll element 208 along the y axis). In general, as the scroll elements 206, 208 are separated, multiple capillary tubes (not distinctly shown) inside the system 100 quickly balance the pressure difference between the high pressure side 110*b* and the low pressure side 110*a*, thus warming up the evaporating temperature of the refrigerants and the fluid temperature. Conversely, when the valve 236 closes the scroll elements 206, 208, the scroll elements 206, 208 work together to compress gas and yield a colder evaporating temperature and fluid temperature. More particularly, when the valve 236 is in a closed position, as shown in FIG. 2, the oscillation of the lower scroll element 208 causes compression of the refrigerant in the central section 220 between the upper fingers 230 of the upper scroll element 206 and the lower fingers 234 of the lower scroll element 208. By contrast, when the valve 236 is switched into the open position, the scroll elements 206, 208 are separated longitudinally (along the y axis), allowing the refrigerant to pass through the central section 220 without compression. Thus, depending on whether the valve 236 in an open position or a closed position, the refrigerant provided from the compressor 112 to the refrigerant line 110 is either uncompressed or compressed, respectively.

Referring now to FIGS. 3A-3D, horizontally sliced cross sections of the central portion 220 of the digital scroll compressor 112 are shown. The components shown include the upper and lower fingers 230, 234 of the upper and lower scroll elements 206, 208, respectively, and the body 232 of the lower scroll element 208. In general, FIGS. 3A-3D show the oscillation cycle of the lower scroll element 208 with respect to the upper scroll element 206 through the change in respective lateral position of the upper and lower fingers 230, 234. Other components of the digital scroll compressor 112 are omitted for simplicity.

Figure 3B:
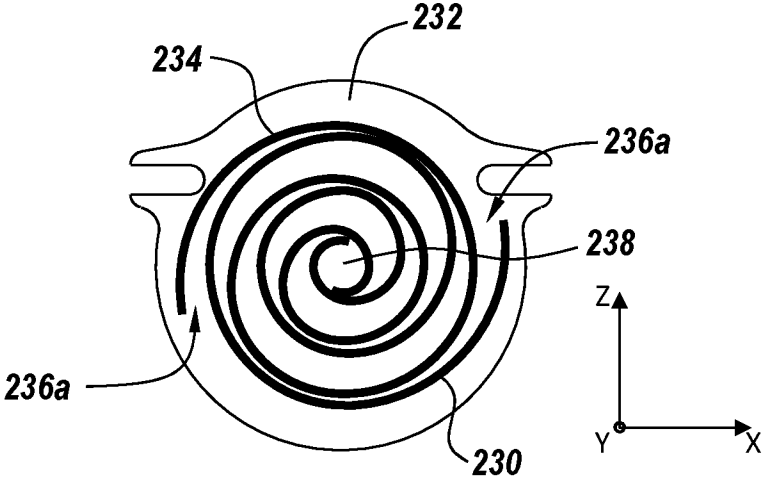
FIGS. 3A-3D are horizontally sliced cross sections of the central portion of a digital scroll compressor in accordance with the subject technology.
Figure 3D:
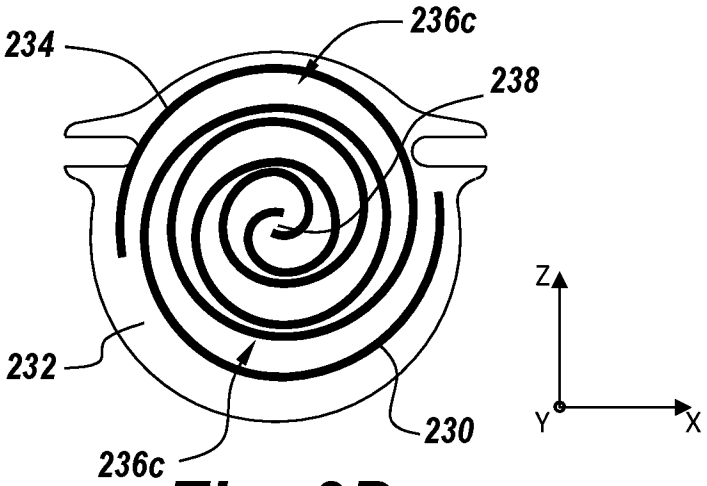
Figure 3A:
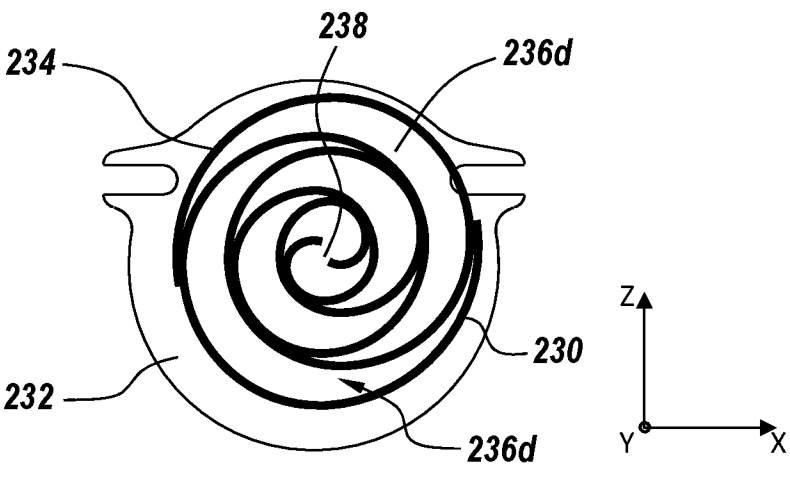
Figure 3C:
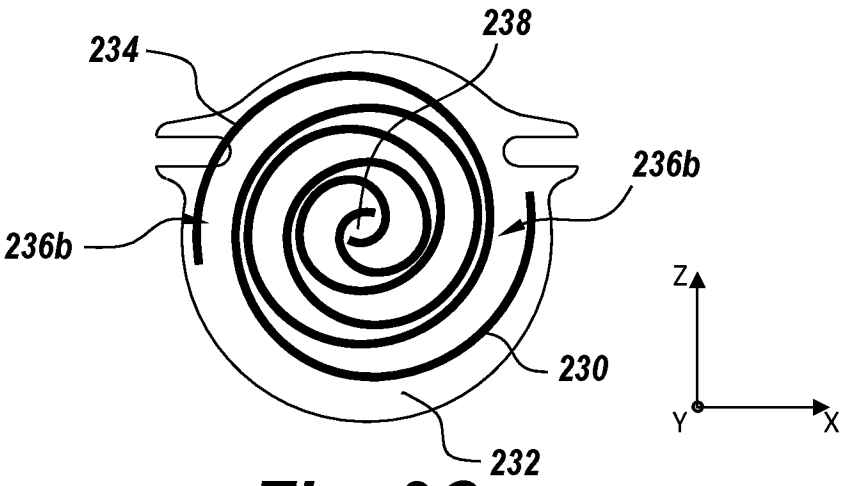

The oscillation cycle is generally a clockwise movement along the x-z plane. FIG. 3A shows a first position where the lower scroll element 208, and thus the lower fingers 234, have oscillated all the way to the right. The lower fingers 234 then rotate 90 degrees to reach the bottommost position, as seen in FIG. 3B. There, some separation is created between the outermost portions of the scroll fingers 230, 234, forming voids 236*a* into which some uncompressed refrigerant enters. As the lower fingers 234 oscillate another 90 degrees, the lower fingers 234 shift to a leftmost position, as seen in FIG. 3C, and the voids 236*b* grow larger, admitting more uncompressed refrigerant. In FIG. 3D, the lower fingers 234 have rotated another 90 degrees and are in a topmost position. As can be seen, the refrigerant contained within the voids 236*c* moves deeper within the scroll elements 206, 208 and begins to become trapped as a result of the oscillation cycle. Turning back to FIG. 3A, the refrigerant within the voids 236*d* is eventually trapped between the fingers 230, 234 of the scroll elements 208, 206. By viewing FIGS. 3A-3D and following the path of the void (generally 236), it can be seen that the volume of the void 236 grows smaller as the lower fingers 234 continue to oscillate and the refrigerant within the void 236 is forced closer to the center 238. Forcing the same mass of refrigerant into a smaller volume causes the refrigerant to compress. Refrigerant at the center 238 is then compressed refrigerant, which is then released into the upper chamber 214 for discharge into the refrigerant line 110.

Figure 4A:
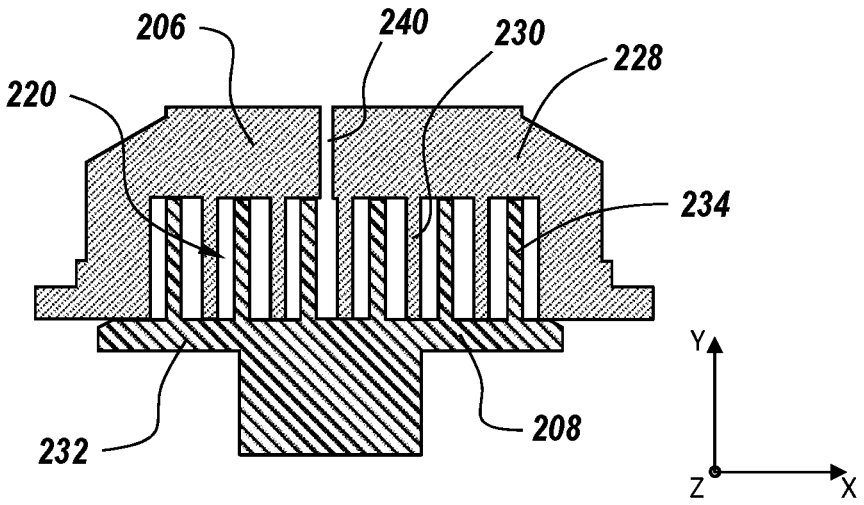
FIGS. 4A-4B are vertically sliced cross sections of the central portion of a digital scroll compressor in accordance with the subject technology.
Figure 4B:
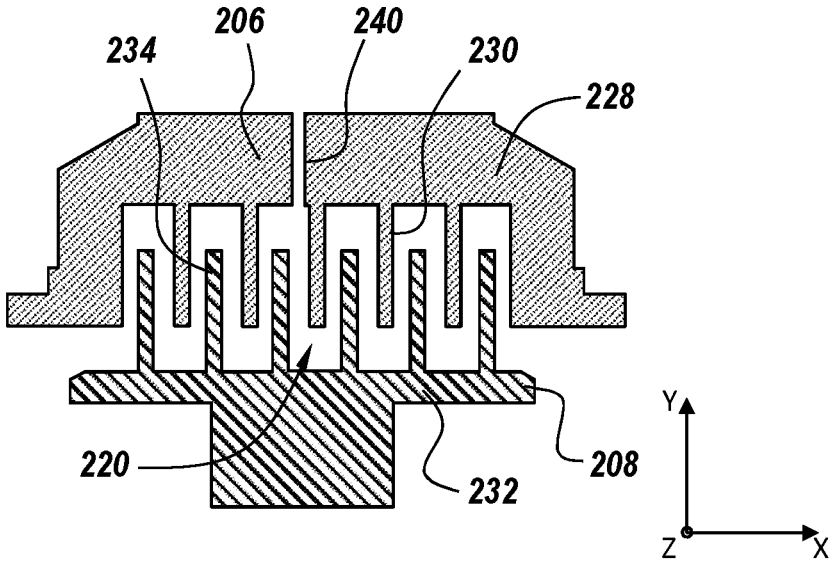

Referring now to FIGS. 4A-4B, vertically sliced cross-sections of a digital compressor 112 are shown. FIGS. 4A-4B show the upper and lower scroll elements 206, 208, with other components being omitted for simplicity. In general, FIGS. 4A-4B show the orientation of the scroll elements 206, 208 when the valve 236 is in a closed position (FIG. 4A) versus when the valve 206 is in an open position (FIG. 4B).

As such, in the closed position of FIG. 4A, the refrigerant in the central section 220 is trapped between the upper and lower fingers 230, 234. Therefore when the scroll elements 206, 208 oscillate, the trapped refrigerant is compressed as described with respect to FIGS. 3A-3D. However, when the valve 236 is in the open position, the central section 220 is enlarged, providing additional space between the scroll element bodies 228, 232. Rather than being compressed, refrigerant can then be redirected into the additional space within the central section 220 when the scroll elements 206, 208 oscillate. Therefore even as the scroll elements 206, 208 oscillate, refrigerant is able to pass through the central section 220, exiting into the upper chamber 214 through a discharge channel 240 without being compressed.

The valve 236 can maintain separation between the scroll elements 206, 208 by various ways as are known in the art. FIG. 1, for example, shows a valve 226 (e.g. a solenoid valve) which forces the two scroll elements 206, 208 to separate to respond to the opening command of the valve 236. For example, the valve 236 may be connected to a pressure line 242 which is able to move the lower scroll element 208 longitudinally based on the hydraulics provided by the pressure line 242.

Figure 5:
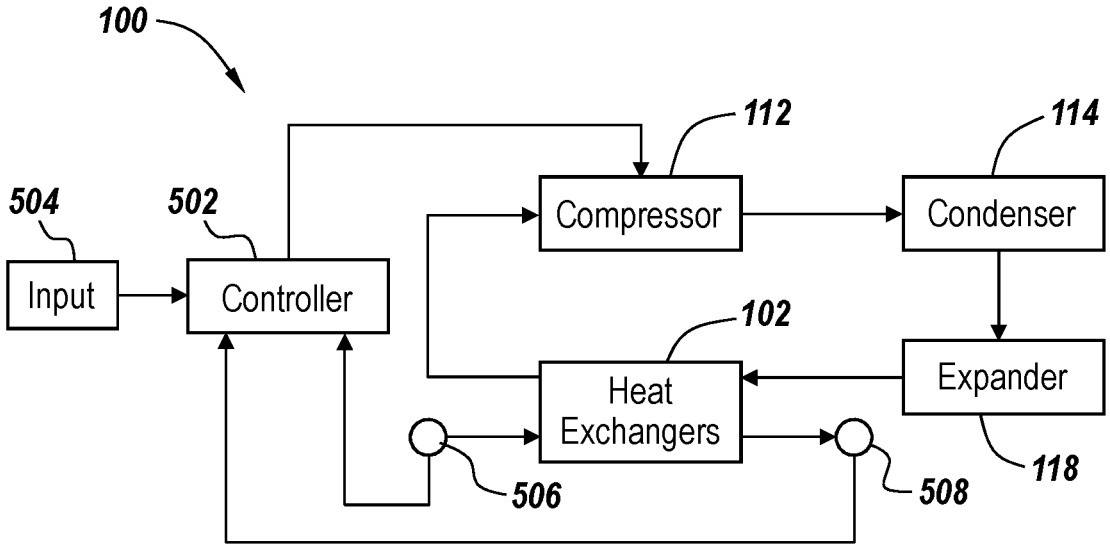
FIG. 5 is a simplified block diagram showing operation of a DUT cooling system in accordance with the subject technology.

Referring now to FIG. 5, a block diagram of a simplified refrigeration system 100 in accordance with the subject technology is shown. Typically, a fluid line 106 (not shown) passes through the heat exchangers 102, carrying a working fluid which is cooled by the refrigeration system 100. A compressor 112 motor 210 rotates at a fixed speed (unchanging rotations per minute). As a result, the flow rate of the compressed refrigerant and the valve 236, which dictates whether refrigerant is compressed within the compressor 112, can be changed in accordance with a set duty cycle to meet the demand of a corresponding DUT testing system. The system 100 relies on measured and/or input variables to determine the set duty cycle. After the fluid is cooled within the heat exchangers 102, the cooled fluid exits the system 100 and can be used in various applications, such as cooling a DUT testing system.

To that end, the controller 502 receives input 504 from a user indicating a desired exit temperature for the cooling fluid (i.e. a target temperature). The controller 502 can be a computer, ASIC, chip, or the like, capable of processing and storing information and sending and receiving signals. The controller 502 works to ensure the fluid is being cooled to the target temperature by actuating the valve 236 of the compressor 112 to either an open or a closed position for a specific duty cycle. The duty cycle can be based on a number of variables. The controller 502 receives feedback from a flow meter 506, which reports the flow rate of fluid through the system 100, and a fluid temperature sensor 508, which reports the current exit temperature of the fluid. An additional fluid sensor can also be provided to report a fluid input temperature of the fluid entering the system 100 to the controller 502. For a given targeted fluid temperature output, the controller 502 commands the valve 236 for a set duty cycle in light of the fluid input temperature and fluid flow rate until the set fluid temperature is met (i.e. the temperature of fluid exiting the system 100 is the target temperature).

If the fluid flow rate increases and the target temperature remains unchanged, the duty cycle is modified such that the valve 236 is positioned in the "closed" position for a greater amount of time during each cycle, yielding a higher compressor capacity output (i.e. the compressor 112 spends more time compressing refrigerant during each cycle). Also, at a given flow rate, if the set target temperature is higher, then the valve is positioned in the "open" position for a greater amount of time during each cycle, decreasing the compressor 112 output.

Since the compressor 112 is built with a thermal overload, an over temperature in the compressor 112 will trip to open the power supply to motor 210, thus stopping the compressor 112. Therefore in some embodiments an unload time limit for the duty cycle is included so that the thermal overload is not tripped. This ensures sufficient cooling gas is provided to the motor 210. For example, an unload time limit of 90% can be set, meaning that the valve 236 will never be in the "open" position for more than 90% of a given duty cycle. Further, the total cycle time of each duty cycle can be limited to some lower limit or minimum cycle time, for example, no less than 10 seconds. A short cycle time does not allow the lubrication to be established to prevent premature wear. In general, cycle times of 10-30 seconds are used in some typical embodiments. The unload time limit and minimum cycle time can be provided through input by the user or preprogrammed into the controller 502.

In some cases, the controller 502 is configured to attempt to cool the fluid to a slightly lower temperature than the target temperature (e.g. between 3 and 7 degrees Celsius, or about 5 degrees Celsius). The fluid can then be heated up to achieve the desired exit fluid temperature. For example, the target temperature for the fluid can be set to −45 degrees Celsius. The controller 502 can then try to cool the fluid to a temperature of −50 degrees Celsius, making the fluid slightly cooler than desired. However, the system 100 can also include a heater 140 (see FIG. 1) configured to heat the fluid up slightly after the fluid has exited the heat exchangers 102. Therefore the system 100 will power up the heater 140 to heat up the air by about 5 degrees Celsius to achieve the target fluid exit temperature of 50 degrees Celsius. Since it is easier to more quickly and precisely heat a fluid than cool it (particularly at the low temperatures within the system 100), this allows the outgoing air temperature to be consistent with the desired target temperature and also saves energy.

Figure 6A:
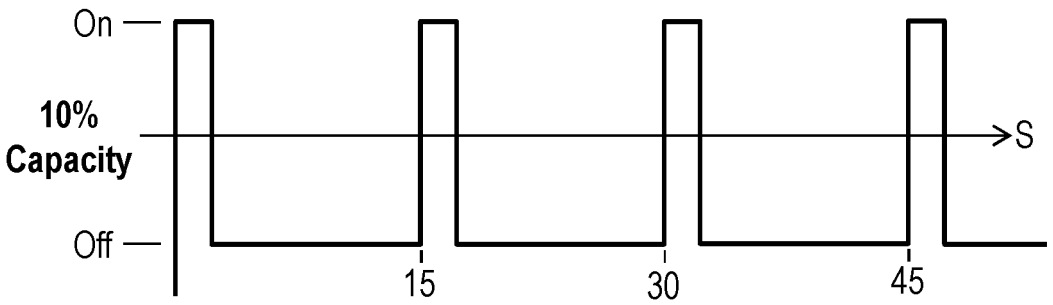
FIGS. 6A-6C are graphs of various exemplary duty cycles for a digital scroll compressor in accordance with the subject technology.
Figure 6B:
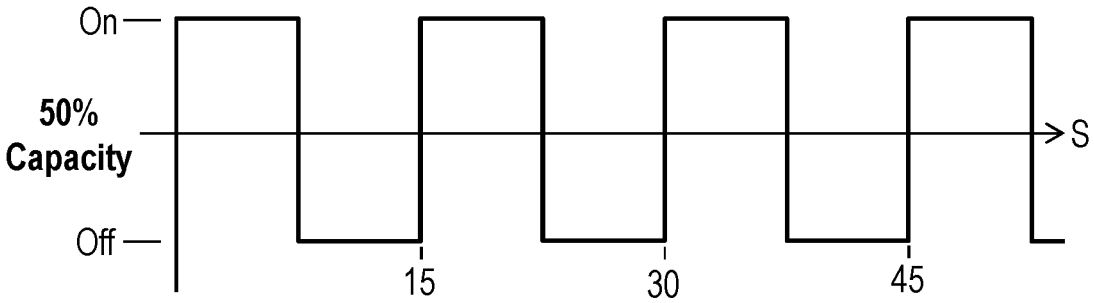
Figure 6C:
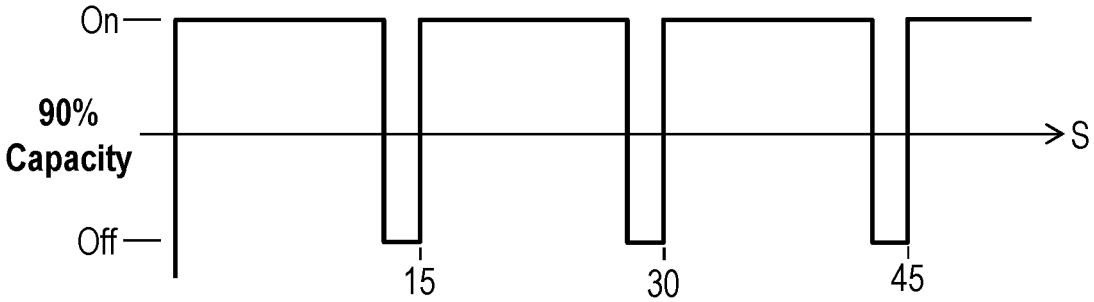

Referring now to FIGS. 6A-6C, examples of various set duty cycles are given. The digital scroll compressor 112 operates in either an "on mode" (i.e. with the valve completely closed) where refrigerant in the compressor 112 is compressed or an "off mode" (i.e. the valve completely open) where refrigerant traveling through the compressor 112 is not compressed. The digital scroll compressor 112 does not operate at variable modes in between completely "on" or completely "off". Therefore, a set duty cycle between on and off modes is employed to adjust the total amount of desired cooling of the system 100 provided by the refrigerant.

As described above, the set duty cycle reflects the amount of time the digital scroll compressor 112 spends compressing refrigerant (i.e. with the valve in the closed position) versus the amount of time the refrigerant traveling through the digital scroll compressor 112 is not compressed (i.e. the valve is in the open position) over a given time period. In FIGS. 6A-6C, that time period is roughly 15 seconds, although different time periods, such as between 10 and 30 seconds, can also be used in other embodiments. Until the set duty cycle is changed, the compressor 112 runs in the on and off positions for set amount of time which is the same over the time period. For example, FIG. 6A represents the compressor functioning at 10% capacity. This means over each 15 second cycle, the compressor is on for roughly 10% of the time, or 1.5 seconds, and off for roughly 90% of the time, or 13.5 seconds (allowing for +/−10% variance in the time spent on and off). Similarly, 6B shows the compressor at 50% capacity, meaning the compressor is on for roughly 7.5 seconds and off for roughly 7.5 seconds. Finally, FIG. 6C shows the compressor at 90% capacity, meaning the compressor is on for roughly 13.5 seconds and off for roughly 1.5 seconds. The set duty cycle is changed to run the compressor 112 at different capacities to try and keep the fluid exit temperature close to the target fluid temperature, as described above. This can be done periodically, determining a new set duty cycle every time a given time period elapses, or a new duty cycle can be implemented by the controller 502 whenever variables and or input data changes significantly.

Figure 7:
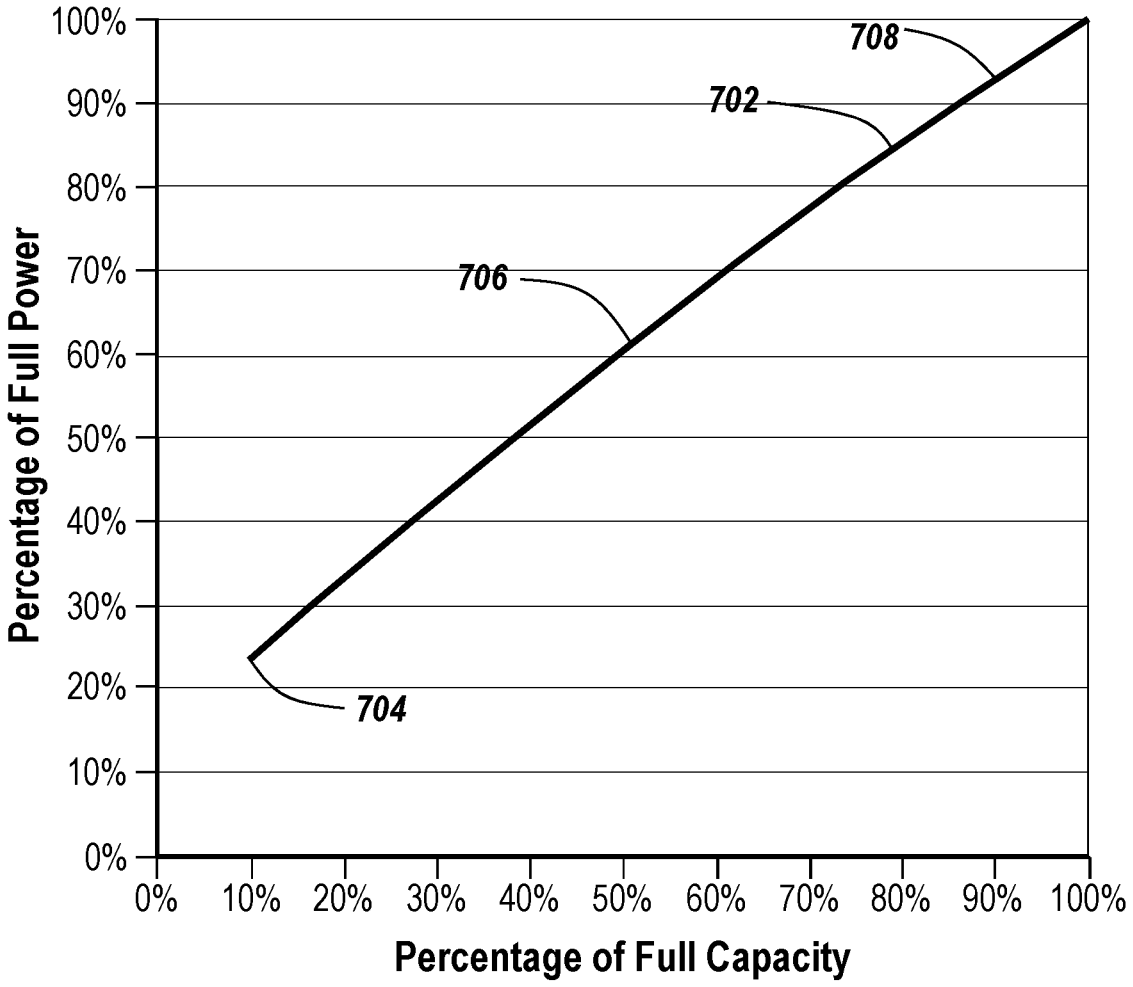
FIG. 7 is a graph of the power usage of a digital scroll compressor versus the capacity at which the compressor is operating in accordance with the subject technology.

Referring now to FIG. 7, a graph of a line 702 showing power consumption of the compressor 112 versus the percentage of operation of full capacity. As the compressor 112 operates at a higher percentage of full capacity, the power consumption of the compressor 112 increases. To operate in the off mode, the compressor requires only about 10% of the energy used as when in the on mode. Therefore when operating at 10% capacity over a given duty cycle as in FIG. 6A, for example, the compressor 112 consumes only about 25% of the maximum power the compressor 112 would otherwise consume when operating at full capacity (see graph point 704). When operating at 50% capacity, as in FIG. 6B, the compressor consumes only about 60% of the power of full capacity (graph point 706). At 90% capacity, as shown in FIG. 6C, the compressor 112 consumes just over 90% of the power of full capacity (graph point 708). Therefore modifying the duty cycle based on the input and measured variables allows the compressor 112 to operate at less than full capacity depending on the target temperature, advantageously reducing power consumption. Similarly, by only cooling the fluid down to, or slightly below the target temperature, rather than to the maximum cooling temperature obtained when operating the compressor 112 at full capacity, the system 100 expends little or no additional energy reheating the cooled fluid. This further conserves energy and costs.

Figure 8:
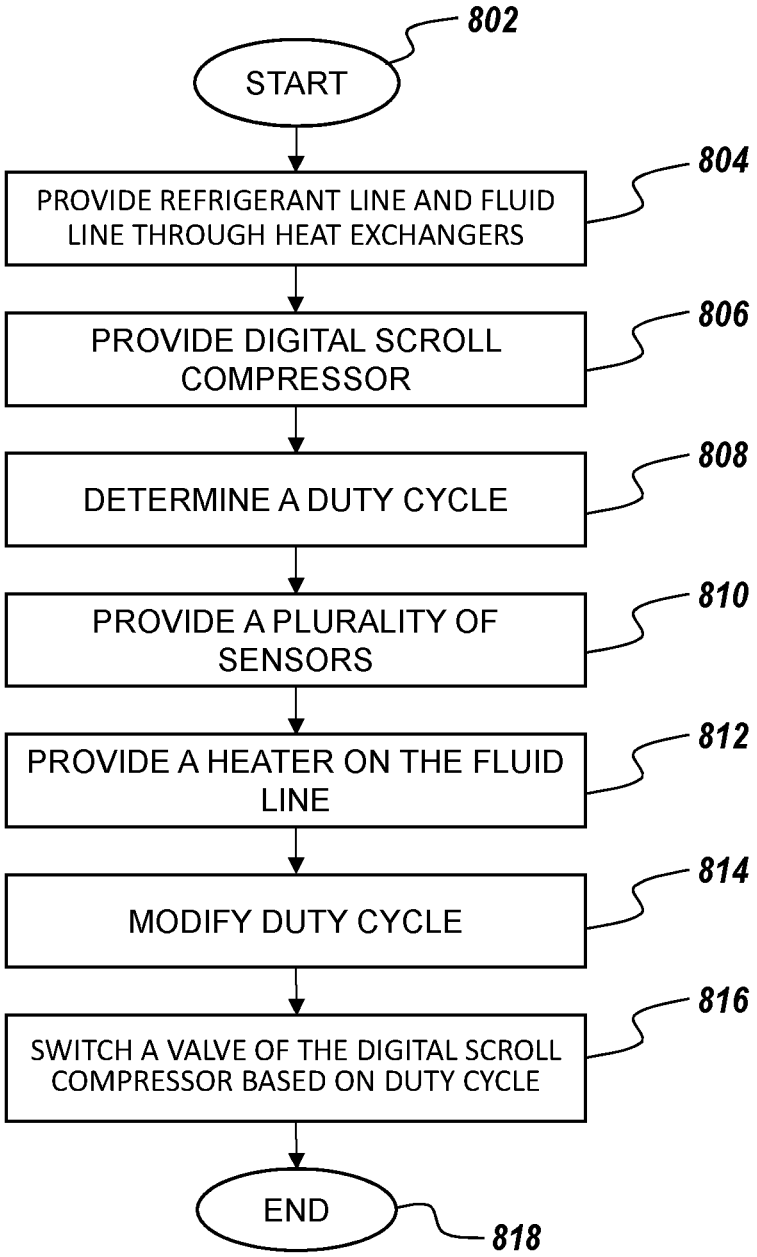
FIG. 8 is a flowchart of a method in accordance with the subject technology.

Referring now to FIG. 8, a method of operating a DUT cooling system in accordance with the subject technology is shown. The method starts at block 802. At step 804, refrigerant and fluid lines 110, 106 are provided such that they extend through a plurality of successively arranged heat exchangers 102. At step 806 a digital scroll compressor 112 is provided. The digital scroll compressor 112 has an intake 202 where refrigerant mixture from the refrigerant line 110 can be provided to the digital scroll compressor 112. In some cases, refrigerant mixture provided at the intake 202 comes from a low pressure side 110*a* of the refrigerant line 110. The digital scroll compressor 112 also has a discharge 204 connecting to the refrigerant line 110 through which refrigerant mixture within the digital scroll compressor 112 is discharged to the refrigerant line 110. In some cases, the refrigerant mixture can be provided to a condenser 114 and then to a high pressure side 110*a* of the refrigerant line 110. Between the intake 202 and discharge 204, the compressor 112 has a plurality of scroll elements 206, 208 for compressing the refrigerant mixture. For example, the scroll elements 206, 208 can be connected to a motor 210 which causes them to oscillate, with respect to one another, to compress refrigerant there between as described above. The motor 210 can be configured to operate uniformly and continuously, causing the scroll elements 206, 208 to likewise oscillate continuously and at a uniform rate. The compressor 112 includes a valve 236 which allows the scroll elements 236 to be selectively separated to avoid compression of refrigerant.

The refrigerant lines 110, fluid lines 106, and digital scroll compressor 112 can be provided at steps 804 and 806 such that they interact in various ways in different embodiments. For example, in some embodiments, the refrigerant line 110 can be configured to provide a refrigerant mixture from a low pressure side 110*b* of the refrigerant line 110 to the intake 202. The refrigerant mixture can have a first, second, and third refrigerants of first, second, and third boiling points, each boiling point differing. For example, the first boiling point can be greater than the second boiling point and the second boiling point can be greater than the third boiling point. Separators 116 can further be provided between the heat exchangers 102. The separators 116 can separate the refrigerant into different mixtures between the heat exchangers 102, providing a first predominately liquid mixture to an expander 118 in the low pressure side 110*a* and a second predominately gaseous mixture to the high pressure side 110*b*.

The digital scroll compressor 112 valve 236 switches between a closed and open position to cause the compressor 112 to switch between an on position where refrigerant is compressed and an off position where refrigerant is not compressed, respectively. The amount of time the digital scroll compressor 112 spends on or off is determined by the set duty cycle.

At step 808, the set duty cycle is determined. This is based, at least in part, on a target cooling temperature for the fluid exiting the system 100. In some cases, the set duty cycle is also based on a number of measured variables. Therefore, at step 810, sensors can be provided to measure variables. A controller 502 can used to determine and set the duty cycle, the controller 502 configured to factor in the additional variables to determine the set duty cycle. In some cases, the variables can include an output temperature of fluid exiting the system 100, a fluid input temperature, and a fluid flow rate. The set duty cycle can also be configured to include an unload time limit, for example 90%, and/or a time length minimum for the set duty cycle after which the duty cycle repeats, for example, at least 10 seconds.

At step 812, a heater 140 can be provided, the heater 140 being thermally connected to the fluid line 106 downstream of the heat exchangers 102. The controller 502 can communicate with the heater 140 to determine when, and to what degree, to activate the heater 140. When a heater 140 is provided, the duty cycle can then be modified, at step 814, such that the system 100 initially cools the fluid within the heat exchangers 102 to slightly below the target temperature (e.g. 3-7 degrees Celsius). The heater 102 is then operated by the controller 502 to raise the temperature slightly before the fluid exits the system 100. This is energy efficient and helpful to maintain temperature stability, as it is more difficult to cool the fluid exactly to the target temperature than it is to cool the fluid to slightly below the target temperature in the heat exchangers 102 and then heat it back up.

At step 816, the valve 236 is operated between the closed and open positions to operate the compressor 112 in the on and off positions, respectively, in accordance with the set duty cycle. The set duty cycle can be changed or modified at different times in accordance with the methods described above. In this way, the method of operating the DUT cooling system 100 can be carried out at all times that cooling fluid is required by a corresponding DUT testing system. The method can then end at step 818.

It will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements (e.g. controllers, circuits, motors, and the like) shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A device under test (DUT) cooling system comprising:

a refrigerant line and a fluid line extending through a plurality of heat exchangers, the heat exchangers arranged successively and configured to transfer heat between a refrigerant mixture in the refrigerant line and a fluid in the fluid line;

a digital scroll compressor having: an intake for providing the refrigerant mixture to the digital scroll compressor; a discharge connecting to the refrigerant line to provide the refrigerant mixture to the heat exchangers; a plurality of scroll elements between the intake and the discharge for compressing the refrigerant mixture; and a valve configured to separate the scroll elements when in an open position to allow refrigerant to flow freely between the intake and the discharge, the scroll elements compressing the refrigerant when the valve is in the closed position;

a plurality of sensors configured to measure a plurality of variables; and a controller configured to: determine a set duty cycle based on a target fluid temperature and the variables; switch the valve between an open and closed position based on the set duty cycle; and determine a new set duty cycle, after a set time period has passed, based on the target fluid temperature and the variables, wherein the set duty cycle is modified to cool the fluid to below the target fluid temperature within the heat exchangers, the system further comprising a heater thermally coupled to the fluid line downstream of the heat exchangers and configured to heat fluid within the fluid line to the target temperature.

2. The system of claim 1, wherein the variables include an output temperature of fluid exiting the system, a fluid input temperature, and a fluid flow rate.

3. The system of claim 1, wherein the digital scroll compressor further comprises a motor oscillating the scroll elements with respect to one another at a uniform rate.

4. The system of claim 1, wherein the set duty cycle includes an unload time limit of 90%.

5. The system of claim 1, wherein the set duty cycle can repeat after at least 10 seconds have passed.

6. The system of claim 1, wherein the set duty cycle is modified to cool the fluid to between 3 and 7 degrees Celsius below the target fluid temperature.

7. The system of claim 1, wherein:

the intake of the digital scroll compressor receives the refrigerant mixture from a low pressure side of the refrigerant line;

the discharge of the digital scroll compressor discharges refrigerant to a condenser, which in turn discharges to a high pressure side of the refrigerant line;

at the intake of the digital scroll compressor, the refrigerant mixture comprises: a first refrigerant having a first boiling point; a second refrigerant having a second boiling point; and a third refrigerant having a third boiling point, the first boiling point being greater than the second boiling point and the second boiling point being greater than the third boiling point; and the system further comprises a plurality of separators, each separator connected to the refrigerant line between two of the plurality of heat exchangers to separate a first mixture from a second mixture, the first mixture being substantially gas and the second mixture being substantially liquid, the first mixture being provided to the high pressure side and the second mixture being provided to an expander before being provided to the low pressure side.

8. The system of claim 7, wherein:

a first separator of the plurality of the separators is connected to the high pressure refrigerant line between a first heat exchanger of the plurality of heat exchangers and a second heat exchanger of the plurality of heat exchangers, the first separator configured to separate a liquid mixture comprising the first and second refrigerant from a gaseous mixture comprising the second and third refrigerants;

the liquid mixture is provided from the first separator to an expander before being provided to the low pressure side of the refrigerant line within the second heat exchanger; and the gaseous mixture is provided to the high pressure side of the refrigerant line within the second heat exchanger.

9. A method of operating a device under test (DUT) cooling system comprising:

providing a refrigerant line and a fluid line extending through a plurality of heat exchangers, the heat exchangers arranged successively and configured to transfer heat between a refrigerant mixture in the refrigerant line and a fluid in the fluid line;

providing a digital scroll compressor having: an intake for providing the refrigerant mixture to the digital scroll compressor; a discharge connecting to the refrigerant line to provide the refrigerant mixture to the heat exchangers; a plurality of scroll elements for compressing the refrigerant mixture between the intake and the discharge; and a valve configured to separate the scroll elements when in an open position to allow the refrigerant mixture to flow freely between the intake and discharge, the scroll elements compressing the refrigerant when the valve is in the closed position;

providing a plurality of sensors configured to measure a plurality of variables;

configuring a controller to: determine a set duty cycle based on the variables; switch the valve between the open position and the closed position based on the set duty cycle such that the fluid exits the system substantially at a target fluid temperature; and after a set time period, determine a new duty cycle based on the target fluid temperature and the variables;

modifying the set duty cycle to cool the fluid to below the target fluid temperature within the heat exchangers;

providing a heater and thermally coupling the heater to the fluid line downstream of the heat exchangers, the heater configured to heat fluid within the fluid line to substantially the target fluid temperature.

10. The method of claim 9, wherein the variables include an output temperature of fluid exiting the system, a fluid input temperature, and a fluid flow rate.

11. The method of claim 9, wherein the digital scroll compressor comprises a motor oscillating the scroll elements with respect to one another at a uniform rate.

12. The method of claim 9, wherein the set duty cycle includes an unload time limit of 90%.

13. The method of claim 9, wherein the set duty cycle repeats after at least 10 seconds have passed.

14. The method of claim 9, further comprising modifying the duty cycle to cool the fluid to between 3 and 7 degrees Celsius below the target fluid temperature.

15. The method of claim 9, further comprising:

connecting the discharge of the digital scroll compressor to a condenser which connects to a high pressure side of the refrigerant line;

connecting the intake of the digital scroll compressor to a low pressure side of the refrigerant line;

providing a refrigerant mixture at the intake of the digital scroll compressor comprising: a first refrigerant having a first boiling point; a second refrigerant having a second boiling point; and a third refrigerant having a third boiling point, the first boiling point being greater than the second boiling point and the second boiling point being greater than the third boiling point; and providing a plurality of separators, each separator connected to the refrigerant line between two of the plurality of heat exchangers to separate a first mixture from a second mixture, the first mixture being substantially gas and the second mixture being substantially liquid, the first mixture being provided to the high pressure side and the second mixture being provided to an expander before being provided to the low pressure side.

16. The method of claim 15, wherein:

a first separator of the plurality of the separators is connected to the high pressure refrigerant line between a first heat exchanger of the plurality of heat exchangers and a second heat exchanger of the plurality of heat exchangers, the first separator configured to separate a liquid mixture comprising the first and second refrigerant from a gaseous mixture comprising the second and third refrigerants;

providing the liquid mixture from the first separator to an expander before being provided to the low pressure side of the refrigerant line within the second heat exchanger; and the gaseous mixture is provided to the high pressure side of the refrigerant line within the second heat exchanger.

* * * * *